United States Patent [19]

Knitzer

[11] Patent Number: 4,883,187

[45] Date of Patent: Nov. 28, 1989

[54] SOFT DRINK ADVERTISING DEVICE

[76] Inventor: Peter Knitzer, 165 West End Ave., #4-J, New York, N.Y. 10023

[21] Appl. No.: 74,871

[22] Filed: Jul. 17, 1987

[51] Int. Cl.[4] ..... B65D 1/00; B65D 41/18; A47G 19/22; A47G 23/03

[52] U.S. Cl. ..... 215/1 R; 215/100 R; 215/100.5; 215/228; 206/457; 220/90.2; 220/306; 229/906.1; 40/311; 40/324

[58] Field of Search ..... 215/1 R, 1 C, 6, 228, 215/229, 100.5, 1 A, 100 A; D9/308; D7/6, 302, 5, 9, 40; 40/311, 324; 220/1 BC, 90.4, 90.2, 306; 229/906.1; 206/457

[56] References Cited

U.S. PATENT DOCUMENTS

| | | | |
|---|---|---|---|
| D. 243,379 | 2/1977 | Meeks | D7/40 X |
| D. 286,967 | 12/1986 | Appel | D7/9 |
| 1,419,509 | 6/1922 | Newell | 215/1 R |
| 1,832,806 | 11/1931 | Dawson | 215/1 R |
| 2,041,563 | 5/1936 | Meinecke | 215/228 X |
| 2,241,501 | 5/1941 | Bates | 215/228 X |
| 3,096,897 | 7/1963 | Hansen | 220/306 X |
| 3,265,520 | 8/1966 | Obenshain | 215/1 R |
| 3,297,193 | 1/1967 | Stevens, Jr. | 220/306 |
| 3,321,124 | 5/1967 | Bank | 215/6 X |
| 3,413,743 | 12/1968 | Goodhue | 40/311 |
| 3,416,687 | 12/1968 | Arnaud | 215/100 A X |
| 3,868,043 | 2/1975 | Freemyer | 220/90.4 |
| 3,874,977 | 4/1975 | Pyles | D7/6 X |
| 4,290,533 | 9/1981 | Rupp et al. | 215/1 R |
| 4,669,282 | 10/1987 | Farrar | 215/12.2 X |

FOREIGN PATENT DOCUMENTS

| | | | |
|---|---|---|---|
| 42930 | 1/1982 | European Pat. Off. | 215/1 C |
| 3538358 | 4/1987 | Fed. Rep. of Germany | D7/6 |
| 2584680 | 1/1987 | France | 215/228 |
| 26085 | 3/1898 | United Kingdom | 40/324 |

*Primary Examiner*—Sue A. Weaver

*Attorney, Agent, or Firm*—Handal & Morofsky

[57] ABSTRACT

An advertising device, comprising a sidewall defining an internal volume for containing a liquid and having an upper open portion and a bottom portion is disclosed. A bottom member closes the said bottom portion. The upper portion of the sidewall extends inward in the region of the upper portion which is uppermost on the tubular sidewall. A bead extends along the outside parameter of the said radially inwardly extending portion of the tubular sidewall. A cap has a tubular sidewall whose cross-sectional shape substantially coincides with the cross-sectional shape of that portion of the tubular sidewall between the upper portion of the tubular sidewall and the lower portion of the sidewall. A top member is secured along the inside of the cap sidewall, the top closing said cap. The inside of the cap sidewall is configured to grip the head to securely close the upper portion with the cap top. The inside of the cap bottom, has ridges or protrusions, to hold the glass steady when the cap is being used as a coaster.

14 Claims, 1 Drawing Sheet

SOFT DRINK ADVERTISING DEVICE

TECHNICAL FIELD

The present invention relates to advertising devices which simulate the appearance and function of a canned beverage product being advertised.

BACKGROUND

Traditionally, soft drink advertising devices have taken a great number of different forms. Perhaps the most common is simply the paper cup bearing the trademark of the particular soft drink involved. For example, who has not seen the bright red and white waxed paper cups bearing the trademark of the Coca Cola Company. Typically, such advertisement bearing cups are used in restaurants, fast food chains, so called "chuck wagons", food stands, and the like. While such devices are in very wide use, nevertheless, they suffer from the basic inadequacy of being disposable items. Thus, once used, they are lost as advertising devices.

Accordingly, paper cups bearing advertising material require a continuing program of introducing the cups into the marketplace. Naturally, as soon as such a program is discontinued, the cups rapidly disappear from sight. In addition, despite the added cost of printing trademarks and other advertising matter on the cups, each time this is done such added value is lost upon the disposal of the cup.

In an attempt to achieve a somewhat longer lasting advertising device, soft drink bottlers have resorted to glasses bearing their trademark. Typically such glasses are sold through retail outlets where their physical attractiveness is calculated to interest the consumer who is in the market to purchase glasses.

Naturally, sales of such glasses are usually limited to purchasers actually already looking for glasses. While the attractive design may attract the occasional impulse buyer, nevertheless, sales are limited to prospective purchasers of glasses. Despite this limitation, once sold such advertising devices have repeated and long value. Nevertheless, such devices are limited because of the limited manner in which the same may be distributed.

Both of the above advertising devices suffer from the inadequacy of not creating a vivid mental picture of the product being advertised. Alternatively, while the free distribution of soft drinks is done on a limited basis, for example in the case of new product introductions, this sort of activity does result in giving the consumer a very vivid picture of the product which one is promoting, such distribution has the side effect of reducing the perceived value of the product (because it is being given away) while at the same time resulting in a one-time advertising display insofar as the cans of the product are generally disposed of after one use.

In accordance with the present invention, the applicant has provided a mechanism for providing repeated advertising value for the inventive advertising device while at the same time simulating the product to be bought, thus short circuiting the mental connection necessary between the advertising device and the product being sold, while at the same time providing the same in a form which is susceptible to mass market distribution on a very wide scale, far greater than only appealing to consumers looking to purchase glasses. In addition no cheapening of the product is introduced.

DISCLOSURE OF INVENTION

The invention, as claimed, is intended to provide a remedy. It solves the problem of providing an advertising device which is of lasting value to the advertiser and which effectively simulates a drinking can's appearance. The device comprises a first vessel portion comprising sidewall and a bottom which closes said sidewall and a cap portion which includes a top and sidewall.

An annular ridge is provided on the inside of the sidewall of the lid. Perforations may be provided on the top of the lid in order to provide means for inserting a straw into the advertising device to drink a liquid contained in the vessel. Perforations on the lid simulate the appearance of a soft drink can. The lid may be made of blown polyethylene impregnated with either grey pigments or metallic pigments in order to simulate the metal top of a soft drink can. Likewise, the glass may be frosted after the application of ceramic color resulting in a more realistic simulation of a metallic finish by the exposed portions of the glass not covered by the simulated label formed by the ceramic color.

BRIEF DESCRIPTION OF DRAWING

One way of carrying out the invention is described in detail below with reference to drawings which illustrate only one specific embodiment, in which.

DETAILED DESCRIPTION OF THE PREFERRED EMBODIMENT

Figure 1:
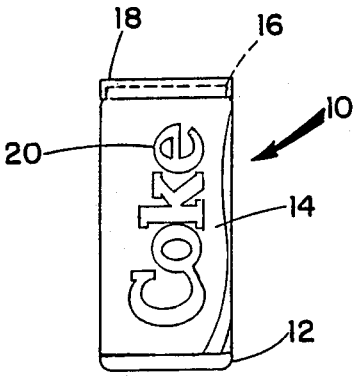
FIG. 1 is a plan view of the inventive advertising device.

As illustrated in FIG. 1, a simulative advertising device constructed in accordance with the present invention is illustrated. Generally the advertising device 10 comprises a drinking vessel 12 made of glass (or plastic if desired) and bearing advertising information in the form of a ceramic coloring material which, in the illustrated embodiment completely surrounds the sidewalls of the vessel 12 in a continuous band 14. The top of vessel 12 comprises a lip 16 which is somewhat smaller in diameter than the remaining portion of vessel 12 and accommodates a cap 18. As can be seen in FIG. 1, the general appearance of device 10 simulates closely the appearance of a conventional metallic soda or beer can, and, in the illustrated example, even includes the logo 20.

Figure 2:
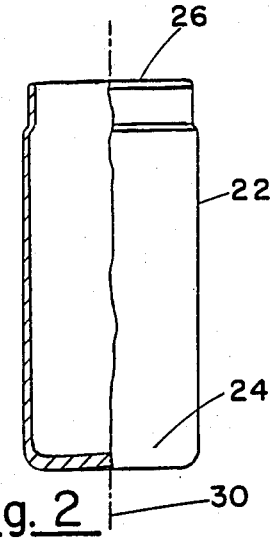
FIG. 2 is a view of the vessel portion of the advertising device of FIG. 1 shown partially in cross section.
Figure 3:
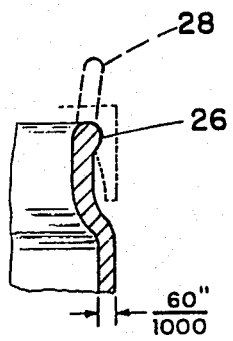
FIG. 3 is a detail of the lip portion of the inventive vessel illustrated in FIG. 2.

Referring to FIG. 2, the vessel 12 generally comprises sidewall 22 and a base member 24. At the top of the vessel is a beaded lip 26, which is illustrated in somewhat greater detail in FIG. 3. Generally, lip 26 is formed in the "burn-off" of the moil 28, which is a defect which remains after the initial glass blowing operation. Nevertheless, this defect is important in that lip 26 is positively engaged by the cap. After the same has been burned off it forms beaded lip 26. Referring back to FIG. 2, which is partially in cross section on the left side of axis 3,, it is noted that the thickness of the base 24 is somewhat greater than that of the sidewall 22. The sidewall 22 typically has a thickness on the order of 0.05 inches. In contrast, the thickness of the base would be in the range of 0.1 to 0.2 inches.

Figure 4:
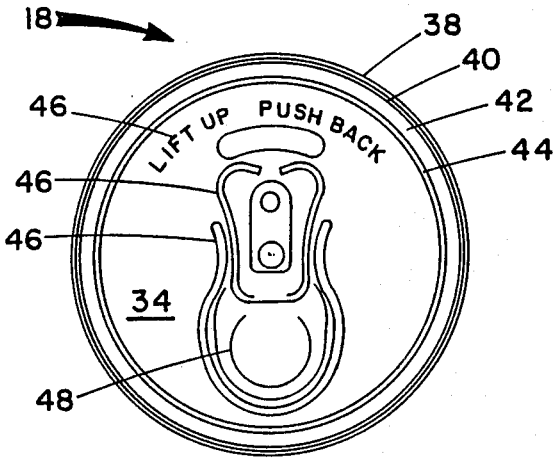
FIG. 4 is a top plan view of a cap for the inventive advertising device.
Figure 5:
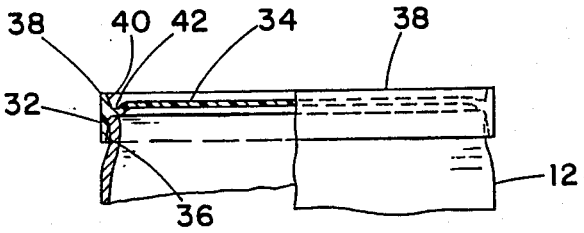
FIG. 5 is a side plan view partly in cross section of the cap of FIG. 4 on the vessel of FIG. 2.
Figure 6:
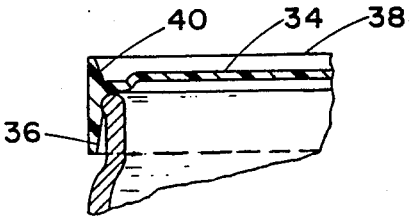
FIG. 6 is an enlarged side plan of a portion of FIG. 5, partially in cross section.

Cap 18 is made of blown polyethylene and incorporates either a grey or silver metallic coloring pigment. The shape of cap 18 is illustrated in FIG. 4 and 5. Generally the cap comprises a sidewall 32 and a top surface 34. An annular ridge 36 is disposed on the inside surfaces of sidewall 32 in order to provide a positive locking action between the cap 18 and the lip 16. The transition between sidewall 32 and top surface 34 is formed by a number of annular surfaces, starting with top edge 38 which is circular in shape and extends around the periphery of the cap. Radially inwardly from top edge 38 is downwardly sloped annular conic surface 40, which in turn leads into circular peripheral surface 42, the inside or bottom surface of which contacts the top surface of the vessel lip 16 when the cap is locked in place, surface 42 in turn leads to upwardly sloping conic surface 44, which meets top surface 34. Cap 18 further includes embossed material 46 which simulates the appearance of the cap of a soft drink can.

Figure 7:
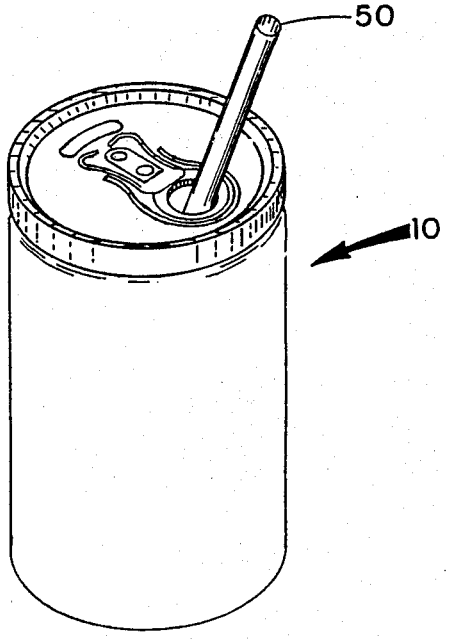
FIG. 7 is a perspective view of the inventive advertising device with a drinking straw extending into it.

Finally, cap 18 may also include a perforation 48, which allows a straw 50 to be forced into the inside of the advertising device when it is filled with a drink, as illustrated in FIG. 7.

In accordance with the present invention the inventive glass is made from a conventional soda lime glass formulation. The glass is formed by blowing a predetermined and carefully measured charge of glass which is introduced into a glass blowing machine, such as that commonly referred to as a Hartford machine. The manufacturing process first involves the measurement and metering of the charge of glass and its delivery to the mold. The delivered and measured glass charge is then blown into the shape illustrated in the drawing. Generally the shape is imperfect insofar as it includes a moil which extends about the perimeterial top of the inventive glass.

After blowing, the blown glass is grasped by the moil and transferred to a conveyor which first passes through a so-called "burn-off" station where the moil is heated and melted to form a finished edge bead about the perimeterial top edge of the glass. The conveyor then passes the glass through a 2½ hour annealing line where it is subjected to intense heat of varying temperatures in order to give the glass strength and remove internal tension from the same. The temperatures to which it is subjected are selected in accordance with a standard annealing process. After annealing, the glasses are hand selected and sent to the decorating department of the glass blowing factory. Here a screen is applied to the glass and hot melt ceramic color is passed to the glass to print the advertising pattern thereon. The ceramic color generally consists of ceramic frit which is applied to the glass through a heated screen in order to print the pattern on the glass.

The glass with the pattern printed on it is then heated to just below the melting temperature of the glass and subjected to a second annealing process which is required because the heating of the glass removed the original annealing.

To complete the simulation, the finished glass, after it has been cooled, is subjected to a corrosive atmosphere which has the effect of frosting the exposed glass. While the exposed glass is frosted, the ceramic color, because it is of a different chemical composition, is not frosted and thus retains its original glossy finish. The selective frosting of the glass thus has the effect of changing those areas which are frosted into a better stimulation of the metal of a soda can. In addition, the locking characteristics of the glass with the plastic lid are thus improved.

Figure 8:
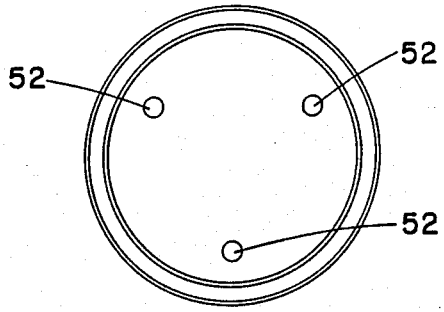
FIG. 8 is a bottom plan view of a cap for the inventive advertising device.

In the event that no perforation 48 is provided to introduce a straw, the bottom of the lid can be modified to act as a coaster and may include several raised areas 52 to hold the vessel 12 as illustrated in FIG. 8.

While an illustrative embodiment of the invention has been disclosed, it is, of course, understood that various modifications will be obvious to those of ordinary skill in the art. For example, the label may be underprinted with silver metallic paint. Such modifications are within the spirit and scope of the invention which is limited and defined only by the appended claims.

I claim:

1. An advertising device substantially proportioned to simulate the shape of a beverage containing can comprising:

(a) a tubular vessel sidewall defining an internal volume for containing a liquid and having an upper open portion and a bottom portion;

(b) a bottom member integral with and closing said bottom portion;

(c) said upper portion of said sidewall extending radially inwardly in the region of said upper portion which is uppermost on said tubular sidewall;

(d) a bead extending along an outside perimeter of said radially inwardly extending portion of said tubular vessel sidewall;

(e) a cap comprising a tubular sidewall whose cross sectional shape substantially coincides with the cross sectional shape of that portion of said tubular vessel sidewall between the upper portion of the tubular vessel sidewall and the lower portion of said vessel sidewall;

(f) said cap comprising a top member secured along the inside of and integral with said cap sidewall, said top member closing said cap; and (g) the inside of said cap sidewall configured, dimensioned and proportioned to grip said head to securely close the upper portion of said vessel sidewall with said cap such that said cap may be repeatedly secured to and disengaged from said vessel sidewall, an undersurface of said top member of said cap being configured to hold a glass in place to enable said cap to be used as a coaster.

2. An advertising device as in claim 1, further comprising an embossed raised portion on said cap top member, said embossed raised portion simulating a can opening structure.

3. An advertising device as in claim 1, wherein the device includes a simulated label made of ceramic frit which is glazed onto said vessel sidewall.

4. An advertising device as in claim 3, wherein said vessel sidewall and said bottom member are made of glass.

5. An advertising device as in claim 4, wherein said glass is frosted to simulate the appearance of metal.

6. An advertising device as in claim 4, wherein said cap sidewall and said top member are made of an integral piece of plastic incorporating a reflective pigment.

7. An advertising device as in claim 6, wherein said pigment comprises a reflective material.

8. An advertising device as in claim 7, wherein said reflection material is metallic.

9. An advertising device as in claim 2, wherein said cap top member includes perforations which coincide substantially with the part of the cap top member which would be opened through the opening of said opening structure of the type simulated by said embossing.

10. An advertising device as in claim 1, wherein said cap sidewall includes an annular ridge and said ridge engages said bead by snapping over said bead.

11. An advertising device substantially proportioned to simulate the shape of a beverage containing can comprising:

(a) a cylindrical glass vessel sidewall defining an internal volume, having an external surface including a simulated label made of ceramic frit which is glazed onto said vessel sidewall and having an upper open portion and a bottom portion;

(b) a bottom member integral with said closing said bottom portion;

(c) said upper open portion of said vessel sidewall having a smaller diameter region coaxial with said internal volume at the uppermost region of said vessel;

(d) a first bead extending along an outside perimeter of said smaller diameter region of said cylindrical vessel sidewall;

(e) a cap comprising a cylindrical sidewall with a top and bottom section having an outside diameter substantially similar to that of said cylindrical vessel sidewall below said smaller diameter region;

(f) said cap further comprising a top member made of plastic incorporating a reflective pigment integral with said cap sidewall, said top member closing the top section of said cap and comprising an embossed raised portion simulating a can opening structure;

(g) a second bead extending along the inside of said bottom section of said cap sidewall dimensioned and proportioned to engage said first bead such that said cap may repeatedly be secured to and disengaged from said cylindrical vessel sidewall; and (h) a hole in said top member which coincides substantially with the embossed feature that would open on a functioning "pop-top" can top simulated on said top member.

12. An advertising device as in claim 11 wherein said cap has an associated gasket surface to sealingly engage the top of said smaller diameter region of said cylindrical vessel sidewall when said cap is secured to said cylindrical vessel sidewall.

13. An advertising device as in claim 12 wherein said second bead is provided with a ramped surface.

14. An advertising device as in claim 11 wherein an undersurface of said top member of said cap is configured to hold a glass in place to enable said cap to be used as a coaster.

* * * * *